United States Patent [19]

Funatsu et al.

[11] 3,939,399

[45] Feb. 17, 1976

[54] POWER CIRCUIT WITH SHUNT TRANSISTOR

[75] Inventors: Michiro Funatsu, Yokohama; Eiichi Matsumura, Tokyo, both of Japan

[73] Assignees: Hitachi, Ltd.; Nippon Electric Co., Ltd., both of Japan

[22] Filed: June 7, 1974

[21] Appl. No.: 477,465

[30] Foreign Application Priority Data

June 11, 1973 Japan ..... 48-64840

[52] U.S. Cl. ..... 323/22 T; 323/8; 323/38

[51] Int. Cl.[2] ..... G05F 1/56; G05F 5/00

[58] Field of Search ..... 323/17, 20, 22 T, 1, 8, 323/9, 38

[56] References Cited

UNITED STATES PATENTS 3,753,078 8/1973 Hedel ..... 323/22 T

*Primary Examiner*—G. Goldberg

*Attorney, Agent, or Firm*—Craig & Antonelli

[57] ABSTRACT

A power circuit is comprised of a control transistor connected in series between one terminal of a power source and one terminal of a load, an error detecting amplifier circuit for detecting and amplifying changes of the load voltage, a drive transistor for driving the control transistor in response to the output current from the error detecting amplifier circuit, an input-output voltage difference detecting transistor which conducts when the difference between the input and the output voltages of the control transistor decreases to below a predetermined value, and a shunt transistor for shunting the current supplied to the drive transistor when it is activated by the output current of the input-output voltage difference detecting transistor. The power circuit operates as a constant voltage circuit when the input voltage is not lower than the predetermined value, while it operates as a ripple filter with a wide operable range when the input voltage decreases to below the predetermined value.

7 Claims, 2 Drawing Figures

POWER CIRCUIT WITH SHUNT TRANSISTOR

The present invention relates to a power circuit serving as a constant voltage circuit when the input voltage thereto is not lower than a determined value while serving as a ripple filter when the input voltage is lower than such value.

The power circuit according to the present invention is well adapted for electronic apparatus, particularly for a television receiver.

The present invention will be described in detail along with prior art with reference to the accompanying drawings, in which.

Figure 1:
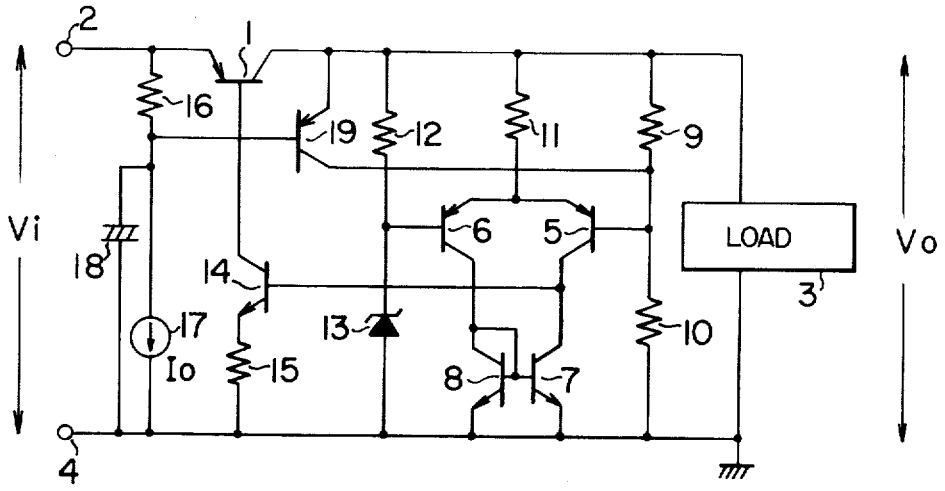
FIG. 1 PRIOR ART
FIG. 1 shows a circuit diagram of a conventional power circuit.

Referring now to FIG. 1, there is shown a conventional power circuit. In the figure, the reference numeral 1 designates a control transistor, and its emitter is connected to an input terminal 2 while its collector is connected to one terminal of a load 3. An error detecting amplifier circuit is constituted by two pairs of transistors 5 and 6, and 7 and 8, resistors 9, 10, 11, and 12, and a Zener diode 13. In the error detecting amplifier circuit, the voltage divided through the resistors 9 and 10 is compared with the voltage across the Zener diode 13 thereby to detect change of the output voltage through the resistors 9 and 10 which in turn is amplified and then supplied to a drive transistor 14. The drive transistor 14 amplifies the error signal from the error detecting amplifier circuit and then supplies it to the control transistor 1 for the control thereof. A bias resistor 15 is connected at one end to the emitter of the transistor 14 and connected at the other end to an input terminal 4. A resistor 16 and a constant current circuit 17 being connected in series are connected between the terminals 2 and 4. A smoothing capacitor 18 is connected across the constant current circuit 17. A transistor 19 is for detecting the difference between the input voltage and the output voltage, and its base electrode is connected to the junction between the resistor 16 and the constant current circuit 17, its emitter electrode to the collector electrode of the control transistor 1, and its collector electrode to the junction between the resistors 9 and 10. $V_i$ designates the voltage between the terminals 2 and 4, $V_o$ the voltage across the load 3.

In the circuit of FIG. 1, a constant current $I_o$ always flows through the resistor 16 and thus the voltage across the resistor 16 is kept constant. The emitter-collector voltage of the control transistor 1 increases with increase of the input voltage $V_i$. That is, the collector voltage of the control transistor 1 is kept constant when the input voltage $V_i$ is not lower than a predetermined value, while, when the input voltage is lower than the predetermined value, it decreases as the input voltage $V_i$ decreases. Accordingly, the resistance for the resistor 16 and the current $I_o$ in the constant current circuit 17 are selected such that the voltage at the junction between the resistor 16 and the constant current circuit 17 is higher than the collector voltage of the control transistor 1 when the input voltage $V_i$ is not lower than the predetermined value, while the voltage at the said junction is lower than the said collector voltage when the input voltage is lower than the predetermined value. Thereby, the transistor 19 is turned off when the input voltage $V_i$ is not lower than the predetermined value, and it is turned on when the input voltage is reduced to a value lower than the predetermined value.

In the circuit shown in FIG. 1, and as described above, the transistor 19 is turned off when the input voltage $V_i$ is not lower than the predetermined value. In this case, when the output voltage $V_o$ increases, the collector current of the transistor 5 decreases but the collector current of the transistor 6 increases. The base voltage of the transistors 7 and 8, is the same as the collector voltage of the transistor 6. The collector voltage increases when the collector current of the transistor 6 increases so that the collector current of the transistor 7 also increases. The collector current of the transistor 5 is divided into a collector current of the transistor 7 and a base current of the transistor 14. However, when the output voltage (or the load voltage) $V_o$ increases, the collector current of the transistor 5 decreases and the collector current of the transistor 7 increases as described above. As a result, the base current of the transistor 14 decreases considerably. This reduction of the base current of the transistor 14 causes the collector currents of the transistors 1 and 14 to decrease and thus the current flowing through the load 3, too, is reduced. Thus, the output voltage $V_o$ is kept constant. When the output voltage $V_o$ decreases, the collector current of the transistor 5 increases but the collector current of the transistor 7 decreases, thereby resulting in an increase of the base current of the transistor 14. As a result, the collector current of the transistor 14 increases and then the collector current of the transistor 1 also increases, and the output voltage $V_o$ increases. Therefore, the output voltage $V_o$ is held constant.

When the input voltage $V_i$ is reduced to below the predetermined voltage, the emitter to collector voltage of the control transistor 1 is lowered so that the emitter voltage of the transistor 19 becomes higher than the base voltage thereof, resulting in the conduction of the transistor 19. Since the transistor 19 is coupled with the resistor 9 in parallel, under this state of the transistor 19, the impedance across the junction between the resistors 9 and 10 and the collector of the transistor 1 is reduced so that the voltage at the junction between the resistors 9 and 10 rises. For this, the collector currents of the transistor 5, 14 and 1 decreases and thus the transistor 1 continues to function as an amplifier without being saturated. Thus, in this case, the circuit shown in FIG. 1 serves as a ripple filter so that the ripple components of the output voltage are removed, although the output voltage $V_o$ decreases.

As described above, the circuit of FIG. 1 serves as a constant voltage circuit when the input voltage $V_i$ is not lower than the predetermined value of voltage, while it serves as the ripple filter for the power source when the input voltage $V_i$ is lower than the predetermined value. This circuit of the prior art, however, suffers from disadvantages described below.

The lower limit of the input voltage $V_i$ at which the circuit loses the function of a ripple filter for the power source, is determined by the voltage at which the Zener diode 13 is cut off due to decreasing of the output voltage $V_o$. More precisely, when the Zener diode 13 is cut off, the transistor 6 is turned off and the maximum collector current flows through the collector of the transistor 5 with the result that the control transistor 1 is saturated to lose the function of a ripple filter. Therefore, in the circuit of FIG. 1, if the output voltage is made low by selecting the resistor 9 to be smaller than the resistor 10 in the resistance, the Zener diode is apt to be cut off, and the difference between the upper limit of the input voltage permitting this circuit to sustain the function of a ripple filter and the lower limit of the input voltage permitting this circuit to lose the function of a ripple filter, i.e., the operable range of the ripple filter is narrowed.

One object of the present invention is to provided an improved and effective power circuit.

Another object of the present invention is to provide an improved and effective power circuit which serves as a constant voltage circuit when the input voltage is not lower than a predetermined value while serves as a ripple filter when the input voltage is lower than that.

Still another object of the present invention is to provide a power circuit in which the operable range as a ripple filter may be widened independent of the set voltage of the constant voltage circuit.

According to a feature of the present invention, a power circuit is provided which comprises: a control transistor connected in series between one terminal of the power source circuit and one terminal of a load; an error detecting amplifier circuit connected across the load for detecting and amplifying changes of the load voltage; a drive transistor for amplifying the output current from the error detecting amplifier circuit and supplying it to the control transistor; a transistor for detecting the difference between the input and output voltages of the control transistor, which conducts to produce an output current in accordance with the voltage difference when said voltage difference decreases to below a predetermined value; and a shunt transistor which conducts in response to the output of the transistor and provides a shunt path for the output current supplied from the error detecting amplifier circuit to said drive transistor.

The power circuit of the present invention functions as a constant voltage circuit when the input voltage is not lower than a predetermined value, while the circuit functions as a ripple filter when the input voltage is reduced to below that value. Furthermore, in the power circuit of the present invention, the output current of the error detecting amplifier circuit is shunted by the shunt transistor, and the lower limit voltage within which the power circuit operates as the ripple filter, corresponds to the input voltage at which the shunt transistor is saturated. Therefore, the input voltage is determined independently of the set output voltage of the power circuit operating with the constant voltage circuit, or independently of the error detecting amplifier circuit. As a result, the power circuit of the present invention permits the widening of the range of the input voltages responsive to which the power circuit operates as the ripple filter.

An explanation of the present invention will be made hereinafter using an embodiment of a power circuit according to the present invention, with reference to FIG. 2.

Figure 2:
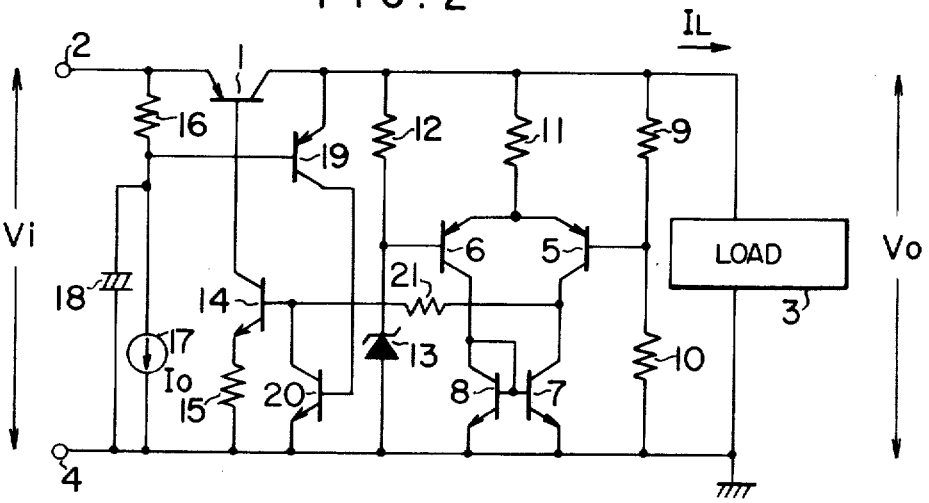
FIG. 2 shows a circuit diagram of a preferred embodiment of the power circuit according to the present invention.

The power circuit shown in FIG. 2 is different from that in FIG. 1 in that the collector of the transistor 19 is connected to the base of a transistor 20 whose collector is connected to the base of the transistor 14 and whose emitter is connected to the input terminal 4, and a resistor 21 is placed between the collector of the transistor 5 and the base of the transistor 14. This circuit also operates as a constant voltage circuit, as in the power circuit in FIG. 1, since, when the input voltage $V_i$ is not lower than a predetermined value, the transistor 19 is cut off and thus the transistor 20 is also cut off.

When the input voltage $V_i$ is reduced to below the predetermined value, the transistor 19 is activitated to supply the base current to the transistor 20, thereby causing the transistor 20 to be turned on. When the transistor 20 is conductive, the collector current of the transistor 5 is shunted to the transistor 20 so that the base current of the transistor 14 decreases and thus the base current and the collector current of the control transistor 1 also decrease. Therefore, the control transistor 1 may maintain its function of amplification without being saturated. In this case, the power circuit of FIG. 2 functions as the ripple filter. In this circuit shown in FIG. 2, when the transistor 20 loses its function of amplification due to its saturation, the transistor 20 can not afford to accept the current from the transistor 5, so that the transistor 14 and 1 loses its amplifying function. For this, the circuit of FIG. 2 does not serve as the ripple filter. More precisely, this circuit loses its function of amplifying when the base voltage of the transistor 14 is equal to the collector voltage at which the transistor 20 loses its amplifying function. The base current of the transistor 14 is determined by the emitter current of the transistor 14 and the resistor 15. The emitter current of the transistor 14 is substantially equal to its collector current. By the way, the collector current of the transistor 14 is the base current of the transistor 1 and its collector current also is the product of the base current and the current amplification factor thereof. The collector current of the transistor 1 is substantially equal to the load current $I_L$. Therefore, the base current of the transistor 14 is determined by the load current $I_L$ and the resistor 15. Thus, if the value of the resistor 15 is selected such that the collector-emitter voltage of the transistor 20 is within the operable range thereof even when the input voltage is low. The range of the input voltages within which this circuit operates as the ripple filter, i.e., the operable range of the ripple filter, can be widened. In other words, the circuit of FIG. 2 may operate as a ripple filter even in the state of low input voltage, if a high resistance is adopted for the resistor 15.

Thus, the lower limit of the input voltage $V_i$ permitting the circuit to sustain a ripple filter is determined by the resistance value of the error detecting amplifier circuit. For this, widening the operable range of the ripple filter is possible.

The equivalent resistance value of the transistor 20 is large under a condition that the circuit shown in FIG. 2 operates as the ripple filter, and the transistor 5 is not yet saturated but with a relatively high input voltage $V_i$. Accordingly, the loop gain of the control circuit consisting of the transistors 1, 14, 19, and 20, is high, and there exists a high possibility of the occurrence of oscillation therein. The resistor 21 is used for preventing this oscillation therein. That is, the connection of the resistor 21 between the collector of the transistor 5 and the base of the transistor 14 causes the collector load of the transistor 5 to increase, thereby resulting in the saturation of the transistor 5. Therefore, such use of the resistor 21 also reduces the collector load of the transistor 20, with the result that the loop gain of the control circuit comprising the transistors 1, 14, 19, and 20, is reduced thereby to prevent oscillation therein.

From the foregoing description, it may be seen that the present invention successfully provides a power circuit that, when the input voltage is not lower than a predetermined value, it functions as a constant voltage circuit, while, when the input voltage is lower than the predetermined one, it also functions as a ripple filter with a wide operable range.

What we claim is:

1. A power circuit comprising:

a control transistor having a control terminal, an input terminal and an output terminal, said input terminal being connected with one terminal of the power source while said output terminal being connected with one terminal of a load;

an error detecting amplifier circuit connected across the load, for detecting and amplifying changes of the load voltage;

a drive transistor having a control terminal being connected with the output terminal of said error detecting amplifier circuit, a common terminal being connected with the other terminals of the power source and of the load, and an output terminal, which is for amplifying the output current of said error detecting amplifier circuit and supplying it to said control transistor;

a transistor for detecting the difference between the input voltage to and the output voltage from said control transistor, which conducts to produce at an output terminal an output current in accordance with said voltage difference when said voltage difference decreases to below a predetermined value of voltage; and a shunt transistor having an input terminal connecting with the control terminal of said drive transistor, an output terminal connected with the other terminals of the power source and the load, and a control terminal connected with the output terminal of said difference detecting transistor to shunt the current supplied from said error detecting amplifier circuit to said drive transistor in accordance with the output current from said difference detecting transistor.

2. A power circuit according to claim 1, in which a resistor is connected between the output terminal of said error detecting amplifier circuit and the control terminal of said drive transistor, thereby to prevent the occurrence of oscillation in the circuit consisting of said control transistor, said difference detecting transistor, said shunt transistor, and said drive transistor.

3. A power circuit according to claim 1, in which a resistor is connected between the common terminal of said drive transistor and the other terminals of the power source and the load.

4. A power circuit according to claim 1, in which a series-connected circuit consisting of a resistor and a constant current source being connected between the input terminal of said control transistor and the other terminal of the power source, the control terminal of said difference detecting transistor is connected to the junction between said resistor and said constant current source, the input terminal of said difference detecting transistor is connected to the output terminal of said control transistor, and the collector is connected to the control terminal of said shunt transistor.

5. A power circuit comprising:

a control transistor whose emitter is connected to one terminal of the power source circuit, and whose collector is connected to one terminal of a load;

an error detecting amplifier circuit connected across the load for detecting the change of the load voltage and amplifying it;

a drive transistor whose base is connected to the output terminal of said error detecting amplifier circuit, whose emitter is connected to the other terminals of the power source circuit and the load, and whose collector is connected to the base of said control transistor for supplying the output current of said error detecting amplifier circuit to the base of said control transistor;

a series-connected circuit consisting of a resistor and a constant current source being connected across the power source circuit;

a detecting transistor whose emitter is connected to the collector of said control transistor whose base is connected to the connecting point of said resistor and said constant current source, which produces the output current at its collector in accordance with the emitter-collector voltage of said control transistor, when the emitter-collector voltage thereof reduces to below a predetermined value; and a shunt transistor whose collector is connected to the base of said drive transistor, whose emitter electrode is connected to the other terminal of the power source circuit, and whose base is connected to the collector of said detecting transistor, which is for shunting the output current from said error detecting amplifier in accordance with the output current of said transistor.

6. A power circuit according to claim 5, in which a resistor is connected between the base of said drive transistor and the other terminal of the power source circuit for establishing the lower limit of the input voltage to permit the said power circuit to operate as a ripple filter.

7. A power circuit according to claim 6, in which a resistor is connected between the output terminal of said error detecting amplifier circuit and the control terminal of said drive transistor, thereby to prevent the occurrence of oscillation.

* * * * *